US011035329B2

(12) United States Patent
Ikegami

(10) Patent No.: US 11,035,329 B2
(45) Date of Patent: Jun. 15, 2021

(54) AIR INTAKE APPARATUS

(71) Applicant: AISIN SEIKI KABUSHIKI KAISHA, Aichi-ken (JP)

(72) Inventor: Ryo Ikegami, Kariya (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 44 days.

(21) Appl. No.: 16/500,212

(22) PCT Filed: Feb. 28, 2018

(86) PCT No.: PCT/JP2018/007588

§ 371 (c)(1),
(2) Date: Oct. 2, 2019

(87) PCT Pub. No.: WO2018/186064

PCT Pub. Date: Oct. 11, 2018

(65) Prior Publication Data

US 2021/0095623 A1 Apr. 1, 2021

(30) Foreign Application Priority Data

Apr. 3, 2017 (JP) ..... JP2017-073487

(51) Int. Cl.
*F02M 35/10* (2006.01)
*F02M 35/104* (2006.01)

(52) U.S. Cl.
CPC ..... *F02M 35/104* (2013.01); *F02M 35/10* (2013.01); *F02M 35/1034* (2013.01); *F02M 35/10354* (2013.01)

(58) Field of Classification Search
CPC ..... F02M 35/104; F02M 35/10; F02M 35/10052; F02M 35/1034; F02M 35/10354; F02M 35/1036
See application file for complete search history.

(56) References Cited

U.S. PATENT DOCUMENTS

2009/0241886 A1* 10/2009 Kameda ..... F02M 35/10222 123/184.21
2015/0285196 A1 10/2015 Yamanari

FOREIGN PATENT DOCUMENTS

| | | | |
|---|---|---|---|
| JP | 2006090210 | A | 4/2006 |
| JP | 2009236018 | A | 10/2009 |
| JP | 2013053582 | A | 3/2013 |
| JP | 2017172514 | A | 9/2017 |
| WO | 2014068381 | A1 | 5/2014 |

OTHER PUBLICATIONS

International Search Report (with English translation) and Written Opinion issued in corresponding International Patent Application No. PCT/JP2018/007588, 1 pages (dated May 15, 2018).

* cited by examiner

*Primary Examiner* — Jacob M Amick
(74) *Attorney, Agent, or Firm* — Buchanan Ingersoll & Rooney PC

(57) ABSTRACT

In an air intake apparatus, a first joining position between an intermediate piece and a first piece in a vicinity of a base of a protrusion of the intermediate piece opposite to an intake port is misaligned along an intake air flow direction with respect to a second joining position between the intermediate piece and a second piece in the vicinity of the base of the protrusion of the intermediate piece.

7 Claims, 5 Drawing Sheets

FIG.7 CONVENTIONAL EXAMPLE
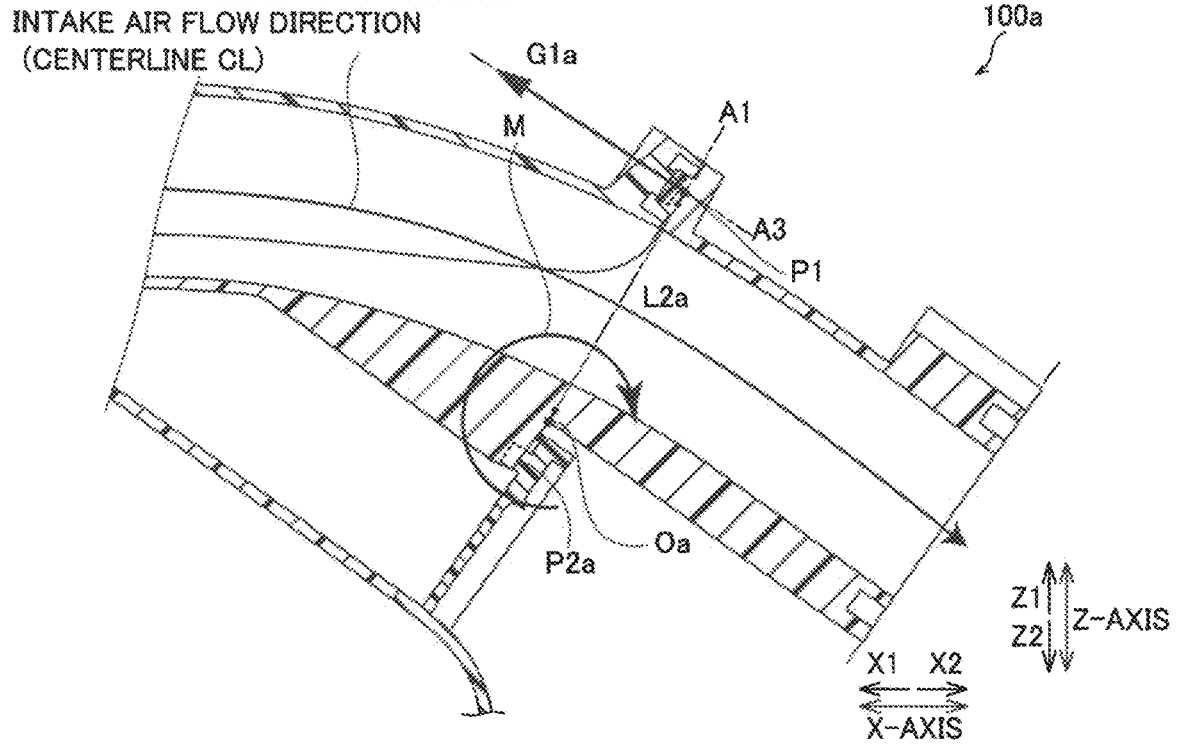
FIG.8
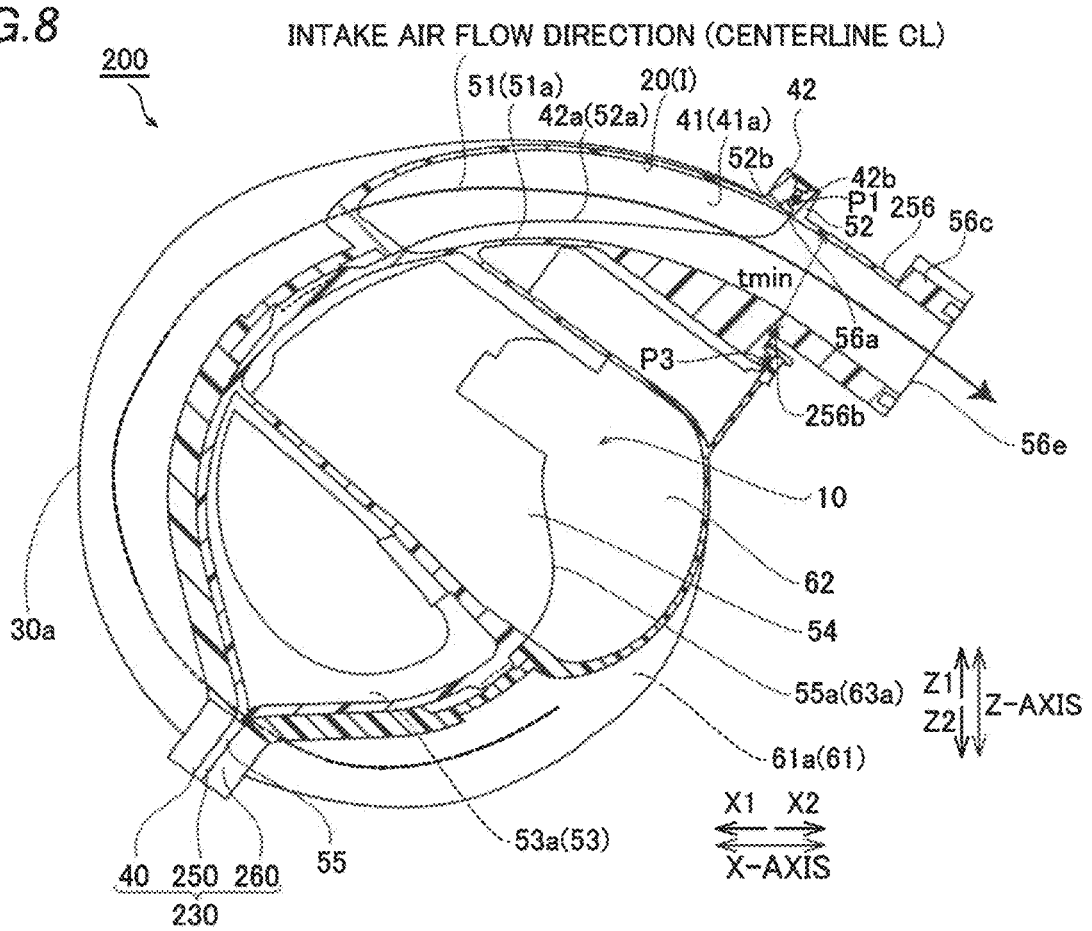

AIR INTAKE APPARATUS

TECHNICAL FIELD

The present invention relates to an air intake apparatus, and more particularly, it relates to an air intake apparatus including a plurality of pieces joined to each other.

BACKGROUND ART

In general, an air intake apparatus including a plurality of pieces joined to each other is known. Such an air intake apparatus is disclosed in Japanese Patent Laid-Open No. 2006-90210, for example.

Japanese Patent Laid-Open No. 2006-90210 discloses an intake manifold (air intake apparatus) including first and second divided case components (intermediate piece), a third divided case component (first piece), and a fourth divided case component (second piece). In this intake manifold, the third divided case component is welded on the engine (internal combustion engine) side and the lower side of the second divided case component. Furthermore, the fourth divided case component is welded on the opposite side to the engine and the upper side of the second divided case component. The first divided case component and an engine-side portion of the second divided case component define a protrusion extending toward the engine and connected to the engine.

In the intake manifold disclosed in Japanese Patent Laid-Open No. 2006-90210, a joining position (first joining position) at the upper ends of the second divided case component and the third divided case component is provided on the lower side of a base of the protrusion. Furthermore, a joining position (second joining position) at the upper ends of the second divided case component and the fourth divided case component is provided on the upper side of the base of the protrusion. The first joining position and the second joining position are both located on a straight line that extends in a direction orthogonal to an intake air flow direction.

When an external force is applied to the intake manifold from the opposite side to the engine while the intake manifold is fixed to the engine, the external force and a reaction force from the engine that resists the external force are applied to the intake manifold. At this time, a moment of a couple about the lower base of the protrusion connected to the engine may be generated in the intake manifold. In this case, at the joining position (second joint position) at the upper ends of the second divided case component and the fourth divided case component, a force in a direction away from the second divided case component is applied to the fourth divided case component based on the moment of a couple.

PRIOR ART

Patent Document

Patent Document 1: Japanese Patent Laid-Open No. 2006-90210

SUMMARY OF THE INVENTION

Problems to be Solved by the Invention

However, in the intake manifold disclosed in Japanese Patent Laid-Open No. 2006-90210, the first joining position and the second joining position are both located on the straight line that extends in the direction orthogonal to the intake air flow direction, and thus the first joining position and the second joining position are close to each other. The force based on the moment of a couple increases as it gets closer to the rotation center, and thus the force in the direction away from the second divided case component applied to the fourth divided case component increases at the second joining position close to the first joining position. Consequently, there is a problem that a joint between the fourth divided case component and the second divided case component is easily separate. A fuel supply component that supplies fuel to the engine is likely to be disposed in the vicinity of the fourth divided case component provided on the upper side in the intake manifold. In this case, when the fourth divided case component is separate from the second divided case component, the fourth divided case component may interfere with the fuel supply component.

The present invention has been proposed in order to solve the aforementioned problems, and an object of the present invention is to provide an air intake apparatus in which separation of joints between a plurality of pieces that form a main body of the air intake apparatus can be significantly reduced or prevented.

Means for Solving the Problems

In order to attain the aforementioned object, an air intake apparatus according to an aspect of the present invention includes an intermediate piece including a protrusion that protrudes from an air intake apparatus main body toward an intake port of an internal combustion engine, and an intake port connection configured to connect to the intake port of the internal combustion engine, a first piece joined to one side of the intermediate piece, the first piece as well as the intermediate piece defining an upstream side of an air intake passage, and a second piece joined to the other side of the intermediate piece, the second piece as well as the intermediate piece defining a downstream side of the air intake passage. Furthermore, a first joining position between the intermediate piece and the first piece in a vicinity of a base of the protrusion of the intermediate piece opposite to the intake port is misaligned along an intake air flow direction with respect to a second joining position between the intermediate piece and the second piece in the vicinity of the base of the protrusion of the intermediate piece.

In the air intake apparatus according to this aspect of the present invention, as described above, the first joining position between the intermediate piece and the first piece in the vicinity of the base of the protrusion of the intermediate piece opposite to the intake port is misaligned along the intake air flow direction with respect to the second joining position between the intermediate piece and the second piece in the vicinity of the base of the protrusion of the intermediate piece. Accordingly, the first joining position in the vicinity of the base serving as a rotation center at which a moment of a couple is generated is misaligned along the intake air flow direction with respect to the second joining position such that as compared with the case in which the first joining position and the second joining position are located at the same position in the intake air flow direction, the second joining position can be moved away from the first joining position and the base. Consequently, when an external force is applied to the air intake apparatus main body from the opposite side to the internal combustion engine, a force based on the moment of a couple at the second joining position can be decreased, and thus a force applied to the second piece in a direction away from the intermediate piece can be decreased. Therefore, separation of a joint between a plurality of pieces (the intermediate piece and the second piece) that constitute the air intake apparatus main body can be significantly reduced or prevented. Thus, even when a fuel supply component is arranged in the vicinity of the second piece of the air intake apparatus main body, interference of the second piece with the fuel supply component can be significantly reduced or prevented when the external force is applied to the air intake apparatus main body from the opposite side to the internal combustion engine.

Furthermore, in the aforementioned air intake apparatus according to this aspect, the first joining position between the intermediate piece and the first piece is located in the vicinity of the base of the protrusion of the intermediate piece. Accordingly, the first joining position between the intermediate piece and the first piece is located in the vicinity of the base serving as the rotation center of the moment of a couple, and thus when the external force is applied to the air intake apparatus main body from the opposite side to the internal combustion engine, the force based on the moment of a couple applied to the intermediate piece and the first piece can be substantially zero or very small. Consequently, separation of a joint between the plurality of pieces (the intermediate piece and the first piece) that constitute the air intake apparatus main body can be significantly reduced or prevented. Therefore, in the air intake apparatus in which the intermediate piece, the first piece, and the second piece are joined to each other, separation of the joint between the plurality of pieces that constitute the air intake apparatus main body can be significantly reduced or prevented when the external force is applied to the air intake apparatus main body from the opposite side to the internal combustion engine.

In the aforementioned air intake apparatus according to this aspect, the first joining position is preferably located further away from the intake port connection than the second joining position in the intake air flow direction.

According to this structure, the first joining position can be easily provided in an inner portion of the air intake apparatus main body, and thus as compared with the case in which the first joining position is located closer to the intake port connection than the second joining position (in an outer portion of the air intake apparatus main body), an unnecessary portion (waste portion) generated in at least one of the first piece and the intermediate piece in order to locate the first joining position can be reduced. Consequently, the weight of the air intake apparatus can be decreased.

In this case, the protrusion preferably extends obliquely downward toward the intake port, the first joining position is preferably provided below the base of the protrusion, the second joining position is preferably provided above the base of the protrusion, and a shortest distance from an end face of the intake port connection to the first joining position is preferably larger than a shortest distance from the end face of the intake port connection to the second joining position.

According to this structure, when the first joining position is provided below the base of the protrusion, and the second joining position is provided above the base of the protrusion, the first joining position can be easily located further away from the intake port connection than the second joining position.

In the aforementioned structure in which the first joining position is located further away from the intake port connection than the second joining position, in a vehicle mounted state, the air intake apparatus main body is preferably disposed in front of the internal combustion engine, the second piece as well as the intermediate piece that constitutes a resonance tube in the air intake passage is preferably disposed on a front end side of the air intake apparatus main body, and the first joining position is preferably located further away from the internal combustion engine than the second joining position.

According to this structure, when the front of the vehicle collides with an obstacle in the vehicle mounted state, and the external force is applied to the air intake apparatus main body such that the second piece is pushed from the front side opposite to the internal combustion engine toward the internal combustion engine (rearward), separation of the joint between the intermediate piece and the second piece can be significantly reduced or prevented.

In the aforementioned air intake apparatus according to this aspect, a joining surface at the second joining position preferably extends along a direction parallel to an end face of the intake port connection, and the first joining position and the second joining position are preferably set in such a manner that a straight line that connects the first joining position to the second joining position is inclined with respect to a direction in which the joining surface at the second joining position extends.

According to this structure, the straight line that connects the first joining position to the second joining position is inclined with respect to the direction in which the joining surface at the second joining position extends such that when the external force is applied to the air intake apparatus main body from the opposite side to the internal combustion engine, a portion of the force based on the moment of a couple at the second joining position can be released in a direction parallel to the joining surface. Consequently, the force applied to the second piece in the direction away from the intermediate piece can be further decreased, and thus separation of the joint between the intermediate piece and the second piece can be further significantly reduced or prevented.

In the aforementioned air intake apparatus according to this aspect, in a vehicle mounted state, the second joining position is preferably located in a vicinity of a fuel supply component.

In this structure in which in the vehicle mounted state, the second joining position is located in the vicinity of the fuel supply component, the first joining position is misaligned along the intake air flow direction with respect to the second joining position such that separation of the joint between the intermediate piece and the second piece can be significantly reduced or prevented. Thus, when the external force is applied to the air intake apparatus main body from the opposite side to the internal combustion engine, interference of the second piece with the fuel supply component can be significantly reduced or prevented.

In the aforementioned air intake apparatus according to this aspect, the first piece, the intermediate piece, and the second piece are preferably made of resins weldable to each other.

In this air intake apparatus in which the first piece, the intermediate piece, and the second piece are welded to each other, it is possible to make it difficult to cause breakage due to the separation when the external force is applied to the air intake apparatus main body from the opposite side to the internal combustion engine and to realize weight reduction.

In the aforementioned air intake apparatus according to this aspect, the first piece as well as the intermediate piece preferably defines the air intake passage on a side of the internal combustion engine, and the second piece as well as the intermediate piece preferably defines the air intake passage on an opposite side to the internal combustion engine.

According to this structure, the entire air intake passage can be defined by the three pieces (the first piece, the intermediate piece, and the second piece), and thus complicated manufacturing of each of the three pieces can be significantly reduced or prevented as compared with the case in which the entire air intake passage is defined by only one or two pieces.

BRIEF DESCRIPTION OF THE DRAWINGS

FIG. 7 An enlarged sectional view of the vicinity of a protrusion in an air intake apparatus according to a conventional example.

FIG. 8 A sectional view of an air intake apparatus according to a modified example of the embodiment of the present invention.

MODES FOR CARRYING OUT THE INVENTION

An embodiment of the present invention is hereinafter described on the basis of the drawings.

The structure of a vehicle 120 equipped with an air intake apparatus 100 according to the embodiment of the present invention is now described with reference to FIGS. 1 and 2.

Figure 1:
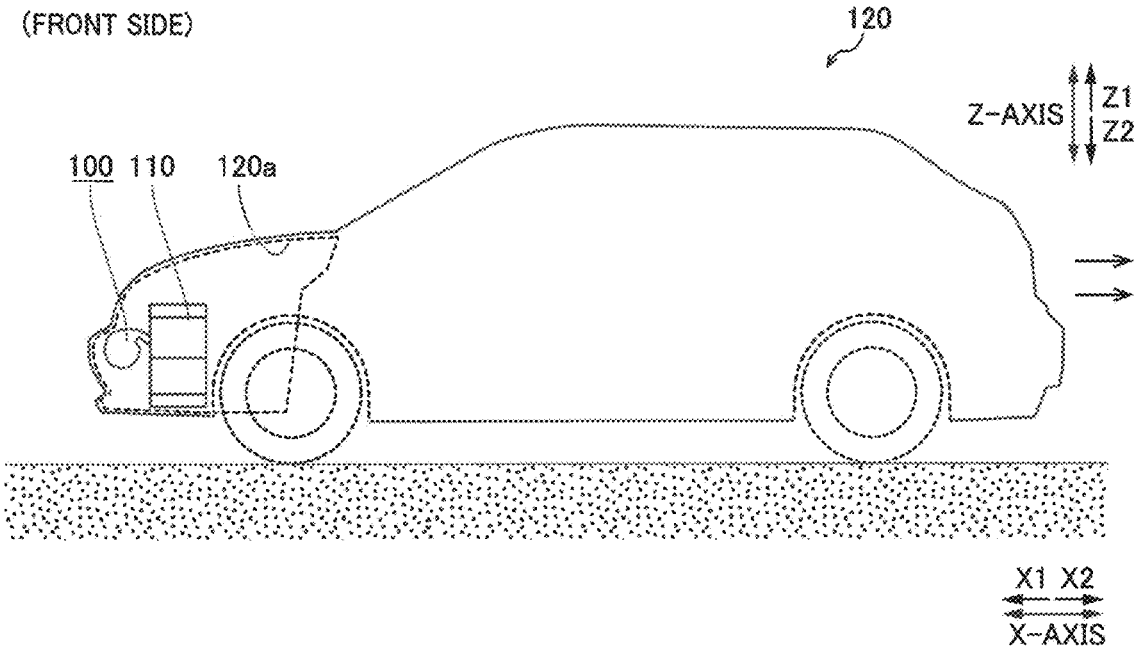
FIG. 1 A diagram schematically showing a vehicle equipped with an air intake apparatus according to an embodiment of the present invention.

As shown in FIG. 1, the air intake apparatus 100 according to the embodiment of the present invention is mounted in an engine room 120*a* of the vehicle 120 while being fixed to an engine 110 (an example of an internal combustion engine). In FIGS. 1 to 8, in the forward-rearward direction (X-axis direction) of the vehicle 120, the engine room 120*a* side is defined as the front side (X1 direction), and the side of the vehicle 120 opposite to the engine room 120*a* is defined as the rear side (X2 direction). In a vertical direction (Z-axis direction), an upward direction is defined as a Z1 direction, and a downward direction is defined as a Z2 direction. A direction orthogonal to the X-axis direction and the Z-axis direction is defined as a Y-axis direction.

The air intake apparatus 100 is disposed in front of the engine 110 in the engine room 120*a* (in a vehicle mounted state).

Figure 2:
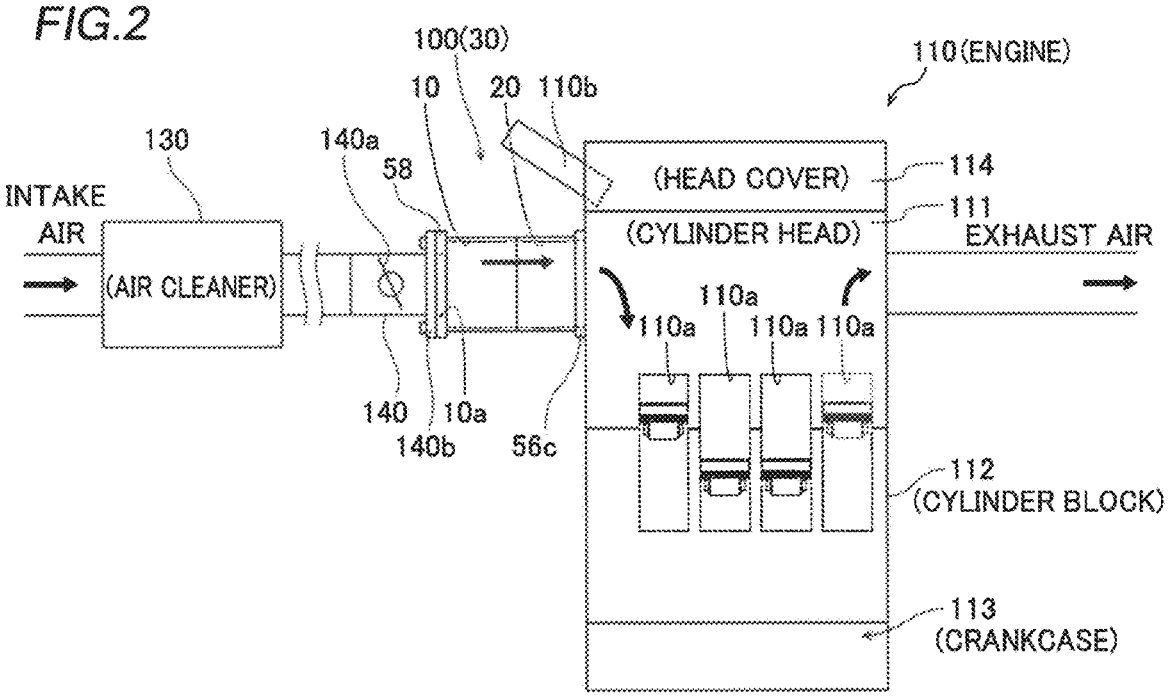
FIG. 2 A schematic view schematically showing arrangements of the air intake apparatus and an engine according to the embodiment of the present invention.

The engine 110 is an in-line four-cylinder engine including four cylinders 110*a*, as shown in FIG. 2. The four cylinders 110*a* are arranged side by side in the Y-axis direction. The engine 110 includes a cylinder head 111, a cylinder block 112 below the cylinder head 111, a crankcase 113 below the cylinder block 112, and a head cover 114 above the cylinder head 111. The engine 110 includes injectors, for example, and a fuel supply component 110*b* that supplies fuel to each cylinder 110*a* is attached. A portion of the fuel supply component 110*b* is located above the air intake apparatus 100.

The air intake apparatus 100 constitutes a portion of an air intake system that supplies air to the engine 110. The air intake apparatus 100 includes an air intake apparatus main body 30 provided with an air intake passage I including a surge tank 10 and a plurality of (four) resonance tubes 20 formed on the downstream side of the surge tank 10. The four resonance tubes 20 are aligned in the Y-axis direction in which the cylinders 110*a* are aligned.

In the air intake apparatus 100, intake air (incoming air) that reaches a surge tank inlet 10*a* (see FIG. 2) flows into the surge tank 10 via an air cleaner 130 and a throttle valve 140*a* of a throttle body 140. Then, the intake air is introduced from the surge tank 10 through the four resonance tubes 20 to each of four intake ports 110*c* (see FIG. 5) of the engine 110. Thereafter, in the air intake apparatus 100, the intake air is introduced into each of the four cylinders 110*a* (see FIG. 2).

(Detailed Structure of Air Intake Apparatus Main Body)

The detailed structure of the air intake apparatus 100 is now described with reference to FIGS. 3 to 6.

Figure 3:
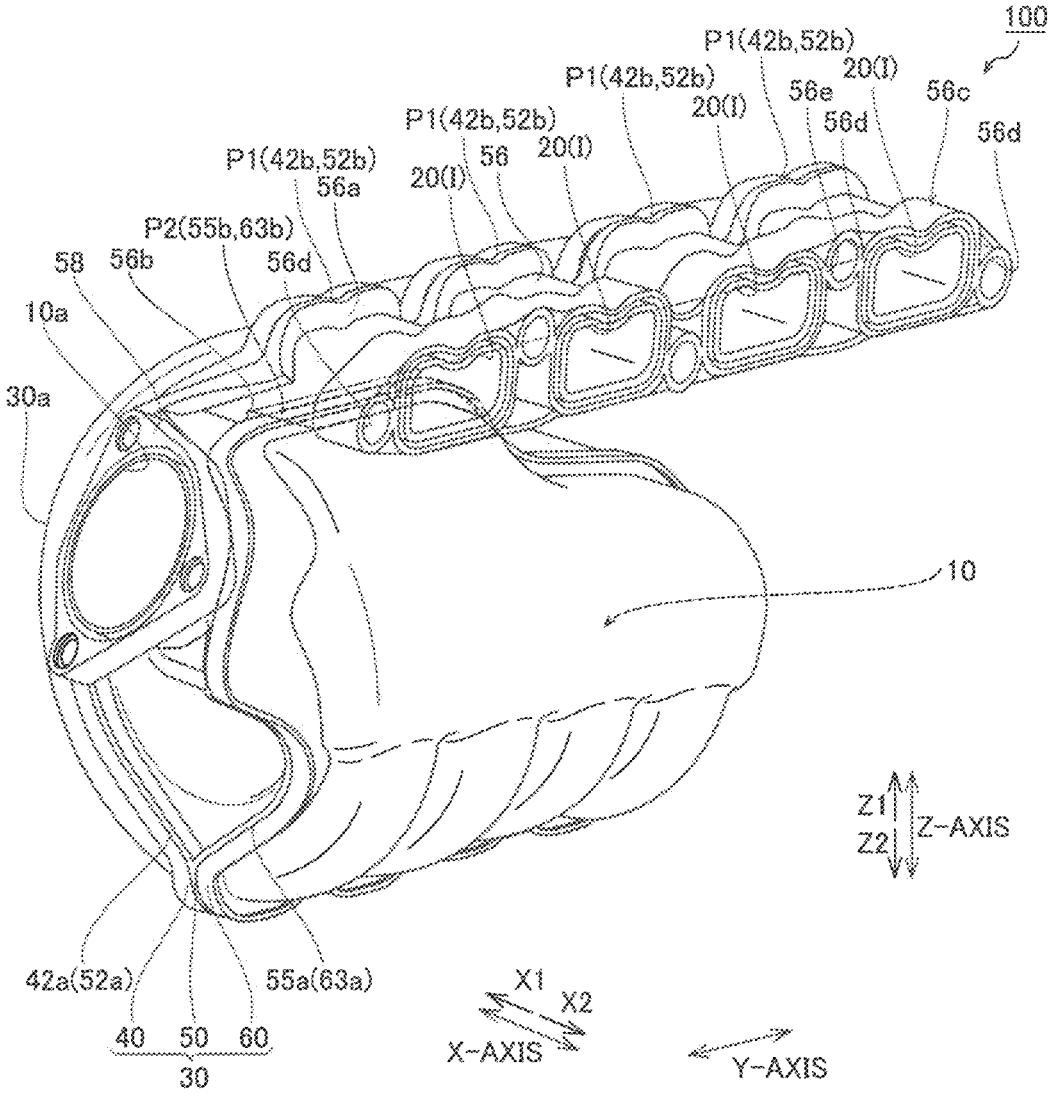
FIG. 3 A perspective view of the air intake apparatus according to the embodiment of the present invention.
Figure 4:
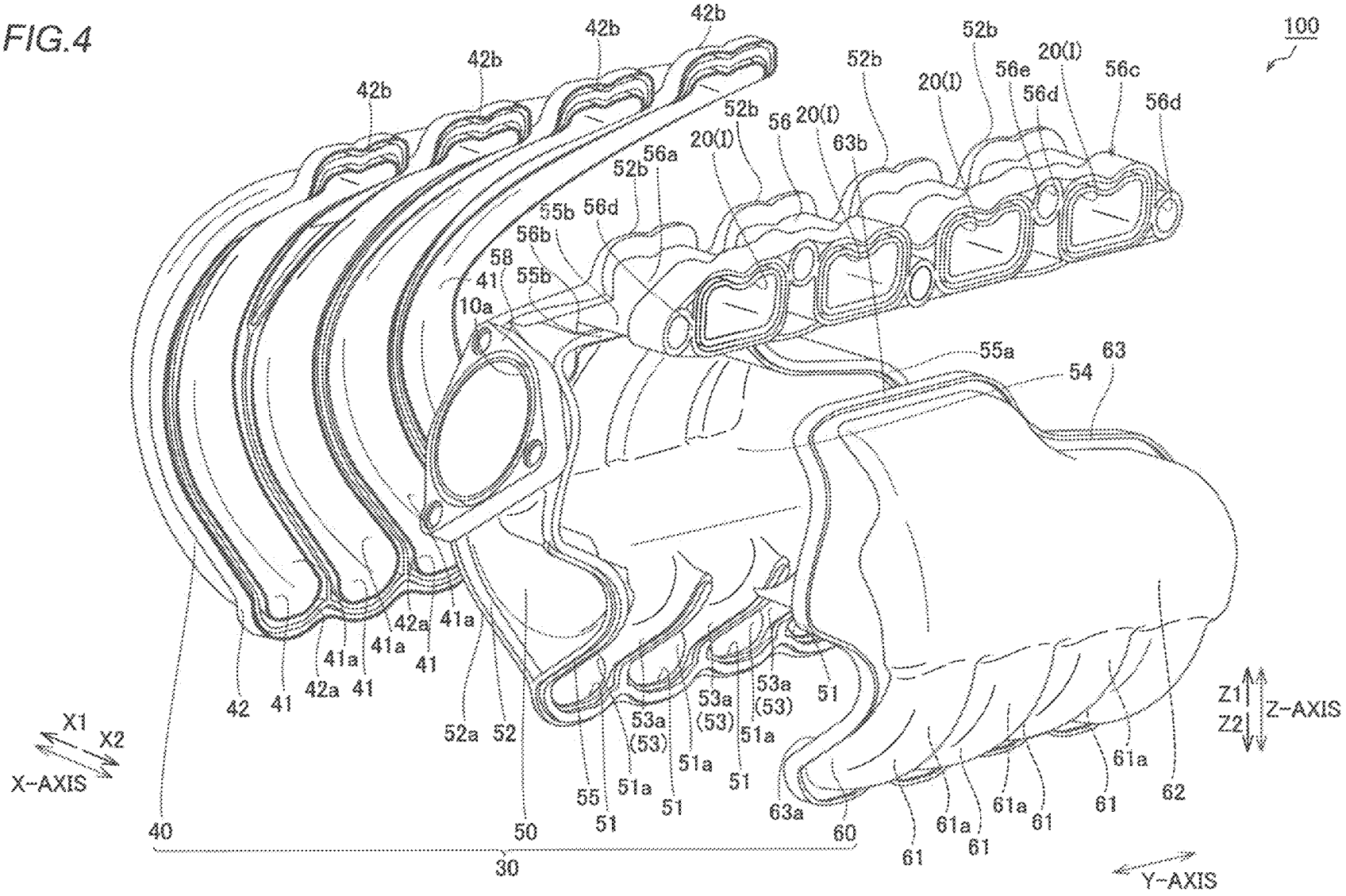
FIG. 4 An exploded perspective view of the air intake apparatus according to the embodiment of the present invention.

The air intake apparatus main body 30 is formed by joining three pieces made of resins (polyamide resins, for example) weldable to each other. Specifically, as shown in FIGS. 3 and 4, an upper piece 40 (an example of a second piece) disposed on the front end 30*a* side of the air intake apparatus main body 30 and a middle piece 50 (an example of an intermediate piece) are integrally joined to each other by vibration welding on the front side (X1 direction side) of the air intake apparatus main body 30. Furthermore, the middle piece 50 and a lower piece 60 (an example of a first piece) arranged on the rear end side of the air intake apparatus main body 30 are integrally joined to each other by vibration welding on the rear side (X2 direction side) of the air intake apparatus main body 30. Thus, the air intake passage I including the surge tank 10 and the four resonance tubes 20 is provided in the air intake apparatus main body 30. The upper piece 40, the middle piece 50, and the lower piece 60 are each formed by injection molding.

The four resonance tubes 20 are set to a predetermined tube length such that so-called Helmholtz resonance can be used.

Figure 5:
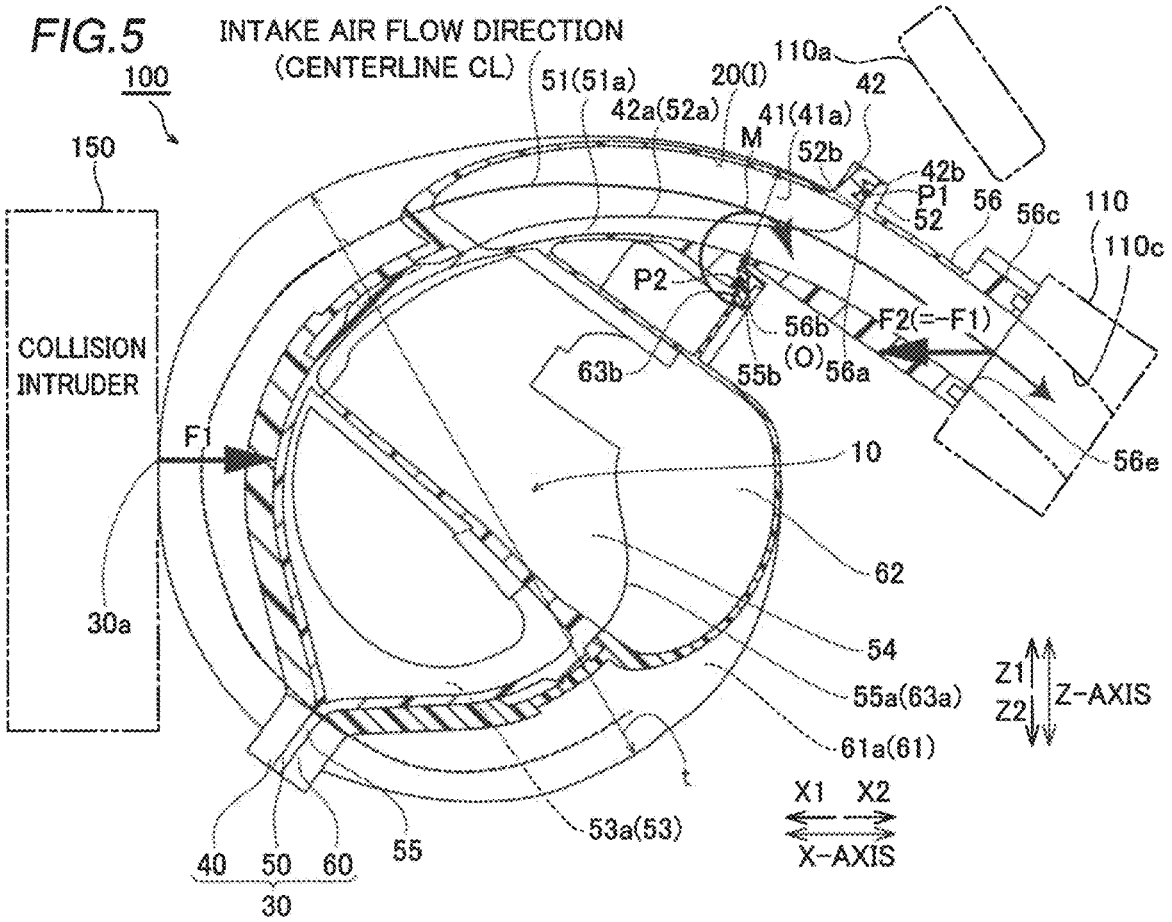
FIG. 5 A sectional view of the air intake apparatus according to the embodiment of the present invention.

As shown in FIG. 5, the downstream side (engine 110 side) of the resonance tubes 20 in the air intake passage I is curved with a bow shape that protrudes forward away from the engine 110. Furthermore, the upstream side (surge tank 10 side) of the resonance tubes 20 in the air intake passage I is curved with a bow shape that protrudes rearward toward the engine 110.

The resonance tubes 20 in the air intake passage I are spirally formed as viewed from the side in the Y-axis direction. Specifically, in each of the resonance tubes 20, a length from the center of a spiral shape inside the air intake apparatus main body 30 to a line (centerline CL) that passes through the center of the resonance tube 20 is gradually decreased from the downstream side toward the upstream side, as viewed from the side in the Y-axis direction. That is, each of the resonance tubes 20 has a spiral shape in which the diameter is larger on the downstream side of the resonance tube 20 having a bow shape that protrudes forward than on the upstream side of the resonance tube 20 having a bow shape that protrudes rearward. Consequently, it is possible to easily ensure the sufficient tube length of the resonance tube 20 as compared with the case in which the resonance tube 20 is linear. Furthermore, the resonance tube 20 has a spiral shape such that the upstream side of the air intake passage I defined by the lower piece 60 and the middle piece 50 is located closer to an inner portion of the air intake apparatus main body 30 than the downstream side of the air intake passage I.

The upper piece 40 is arranged at a position that overlaps with a portion of the fuel supply component 110*b* in a top view. Accordingly, it is not necessary to arrange the air intake apparatus 100 while avoiding the fuel supply component 110*b* as compared with the case in which the entire air intake apparatus is arranged at a position that does not overlap with the fuel supply component in the top view, and thus the engine 110 and the air intake apparatus 100 can be easily arranged in a limited space of the engine room 120*a*.

The upper piece 40 constitutes the front sides (X1 direction sides) of downstream portions of the resonance tubes 20. As shown in FIGS. 3 to 5, the upper piece 40 includes four air intake passage constituent portions 41 that constitute the downstream portions of the resonance tubes 20, and a flange 42 that surrounds the outer peripheries of the four air intake passage constituent portions 41. The four air intake passage constituent portions 41 are recessed forward, and are partitioned from each other by walls 41*a*.

The upper piece 40 is joined (welded) to a joining surface 52*a* (described below) of the middle piece 50 on its entire joining surface 42*a* formed on the rear side (X2 direction side). Of the joining surface 42*a*, a joining surface 42*b* at the upper end of the flange 42 extends along an A1 line (see FIG. 6) that extends in a direction orthogonal to an intake air flow direction.

The middle piece 50 constitutes the rear sides of the downstream portions of the resonance tubes 20. The middle piece 50 includes four downstream air intake passage constituent portions 51 that constitute the downstream portions of the resonance tubes 20 and a flange 52 that circumferentially surrounds each of the four downstream air intake passage constituent portions 51. The four downstream air intake passage constituent portions 51 are recessed rearward, and are partitioned from each other by walls 51*a*.

The middle piece 50 is joined (welded) to the joining surface 42*a* of the upper piece 40 over the entire joining surface 52*a* formed on the front side. Moreover, of the joining surface 52*a*, a joining surface 52*b* at the upper end of the flange 52 extends in an A1 direction similarly to the joining surface 42*a* of the upper piece 40.

The middle piece 50 constitutes the front sides of upstream portions of the resonance tubes 20 and the surge tank 10. The middle piece 50 includes four upstream air intake passage constituent portions 53 that constitute the upstream portions of the resonance tubes 20, a surge tank constituent portion 54 that constitutes the surge tank 10, and a flange 55 that circumferentially surrounds the four upstream air intake passage constituent portions 53 and the surge tank constituent portion 54. The upstream air intake passage constituent portions 53 and the surge tank constituent portion 54 are formed in such a manner that each resonance tube 20 and the surge tank 10 communicate with each other. The four upstream air intake passage constituent portions 53 are recessed forward, and are partitioned from each other by walls 53*a*. Moreover, the surge tank constituent portion 54 is recessed forward.

The middle piece 50 is joined (welded) to a joining surface 63*a* (described below) of the lower piece 60 over its entire joining surface 55*a* formed on the rear side.

The lower piece 60 constitutes the rear sides of the upstream portions of the resonance tubes 20 and the surge tank 10. The lower piece 60 includes four air intake passage constituent portions 61 that constitute the upstream portions of the resonance tubes 20, a surge tank constituent portion 62 that constitutes the surge tank 10, and a flange 63 that circumferentially surrounds the four air intake passage constituent portions 61 and the surge tank constituent portion 62. The air intake passage constituent portions 61 and the surge tank constituent portion 62 are formed in such a manner that each resonance tube 20 and the surge tank 10 communicate with each other. The four air intake passage constituent portions 61 and the surge tank constituent portion 62 are recessed rearward. Furthermore, the four air intake passage constituent portions 61 are partitioned from each other by walls 61*a*.

The lower piece 60 is joined (welded) to the joining surface 55*a* of the middle piece 50 over the entire joining surface 63*a* formed on the front side.

The middle piece 50 constitutes the most downstream portions of the resonance tubes 20. The middle piece 50 includes a protrusion 56 that extends from the joining surface 52*b* toward the engine 110 on the upper side and extends from the vicinity of the joining surface 55*b* toward the engine 110 side on the lower side. Consequently, the joining surface 42*b* at the upper end of the upper piece 40 and the joining surface 52*b* at the upper end of the middle piece 50 are joined to each other in the vicinity of the upper side of a base 56*a* formed on the upper side of the protrusion 56 so as to form a joint. That is, a joining position P1 (an example of a second joining position) at the upper ends of the upper piece 40 and the middle piece 50 is provided in the vicinity of the upper side of the base 56*a* on the upper side of the protrusion 56. The joining position P1 is provided above each of the four resonance tubes 20.

The joining surface 55*b* at the upper end of the middle piece 50 and a joining surface 63*b* at the upper end of the lower piece 60 are joined to each other in the vicinity of the lower side of a base 56*b* on the lower side of the protrusion 56 to form a joint. That is, a joining position P2 (an example of a first joining position) at the upper ends of the middle piece 50 and the lower piece 60 is provided in the vicinity of the lower side of the base 56*b* on the lower side of the protrusion 56. A distance D between the base 56*b* and the joining position P2 is about ⅕ or less of tmin described below, for example, and is sufficiently small.

The protrusion 56 constitutes the four resonance tubes 20 independently. Furthermore, as shown in FIG. 5, the protrusion 56 extends obliquely rearward and downward toward the intake ports 110*c*. The protrusion 56 extends linearly toward the intake ports 110*c*.

The protrusion 56 includes a flange 56*c* (an example of an intake port connection) configured to connect to the intake ports 110*c* of the engine 110. As shown in FIGS. 3 and 4, the flange 56*c* is circumferentially formed so as to surround the four resonance tubes 20 at an end of the protrusion 56 on the engine 110 side (the end on the X2 direction side) and its periphery. A plurality of insertion holes 56*d* into which fastening members (not shown) are inserted are provided in the flange 56*c*. Consequently, the air intake apparatus 100 is fixed to the engine 110 by the fastening members. At this time, an end face (joining surface 56*e*) of the flange 56*c* on the engine 110 side comes into contact with the outer surface of the engine 110. The joining surfaces 42*b* and 52*b* that extend along the A1 line extend along a direction substantially parallel to the joining surface 56*e*.

Figure 6:
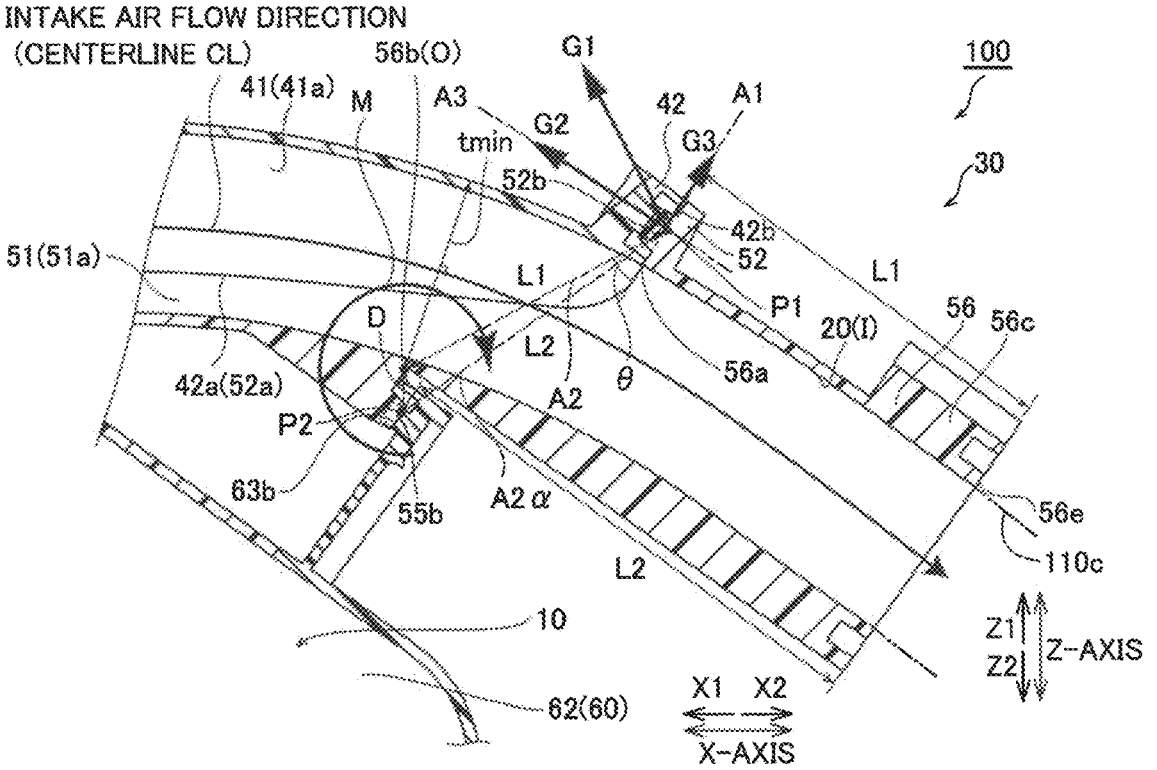
FIG. 6 An enlarged sectional view of the vicinity of a protrusion in the air intake apparatus according to the embodiment of the present invention.

In this embodiment, as shown in FIG. 6, the joining position P2 between the middle piece 50 and the lower piece 60 in the vicinity of the lower base 56*b* of the protrusion 56 of the middle piece 50 opposite to the intake port 110*c* is misaligned along the intake air flow direction with respect to the joining position P1 between the upper piece 40 and the middle piece 50 in the vicinity of the base 56*a* of the protrusion 56 of the middle piece 50. Specifically, the joining position P2 and the lower base 56*b* in the vicinity of the joining position P2 are located on the front side (X1 direction), which is a position further away from the flange 56*c* and the intake port 110*c* than the joining position P1 in the intake air flow direction.

In this embodiment, the air intake apparatus main body 30 is formed in such a manner that the thickness t of the air intake apparatus main body 30 in the direction orthogonal to the intake air flow direction is minimized (tmin) at the lower base 56*b*. Thus, the lower base 56*b* becomes a rotation center O at which a moment of a couple is generated.

The shortest distance L2 from the joining surface 56*e* of the flange 56*c* on the engine 110 side to the joining position P2 is larger than the shortest distance L1 from the joining surface 56*e* of the flange 56*c* to the joining position P1. Similarly, the shortest distance from the joining surface 56*e* of the flange 56*c* to the base 56*b* is larger than the shortest distance from the joining surface 56*e* of the flange 56*c* to the base 56*a*. In addition, the lower side of the base 56*b* of the protrusion 56 at which the joining position P2 is located is provided at a position at which the length of the protrusion 56 is minimized in a direction orthogonal to the joining surface 56*e* of the flange 56*c*.

An A2 line that passes through the lower base 56*b* as the rotation center O and the joining position P1 intersects with the A1 line along which the joining surfaces 42*b* and 52*b* extend. Consequently, an A2α line that passes through the joining position P2 located in the vicinity of the lower base 56*b* and the joining position P1 also intersects with the A1 line along which the joining surfaces 42*b* and 52*b* extend. An angle θ defined by the A1 line and the A2 line is preferably about 20 degrees or more in order to sufficiently space the base 56*a* apart from the joining position P1. Note that when the angle θ defined by the A1 line and the A2 line is excessively large, the air intake apparatus main body 30 is increased in size, and thus the angle θ is preferably about 60 degrees or less. The angle θ defined by the A1 line and the A2 line is only required to be an acute angle, and may be more than about 0 degrees and less than about 20 degrees or may be more than about 60 degrees.

As shown in FIGS. 3 and 4, a flange 58 to which a flange 140*b* (see FIG. 2) of the throttle body 140 is connected is integrally formed on one side of the middle piece 50 in the Y-axis direction. The flange 58 surrounds the surge tank inlet 10*a*. As shown in FIG. 3, the flange 58 is provided below the joining position P2 and in the vicinity of the joining position P2, as viewed from the side in the Y-axis direction. The flange 58 is integrally formed on the middle piece 50 such that the mechanical strength (rigidity) around the flange 58 can be improved, and thus it is possible to significantly reduce or prevent the occurrence of inconveniences, such as distortion and breakage, in the air intake apparatus 100 due to the weight of the throttle body 140.

(Mechanical Explanation at Time of Collision)

The case in which an external force is applied to the air intake apparatus main body 30 is now described with reference to FIG. 1 and FIGS. 5 to 7.

When the front side (X1 direction) of the vehicle 120 collides with a colliding object such as a wall, a collision intruder 150 intrudes into the engine room 120*a* (see FIG. 1), as shown in FIG. 5. At this time, an external force F1 directed rearward (X2 direction) is applied to the front side of the air intake apparatus main body 30 disposed in front of the engine 110. Note that the external force F1 is applied to the upper piece 40 located at the front end 30*a* in the air intake apparatus main body 30.

The air intake apparatus main body 30 is fixed to the engine 110 at the flange 56*c*, and thus when the external force F1 is applied to the air intake apparatus main body 30, a reaction force F2 directed forward from the engine 110 is applied to the air intake apparatus main body 30 so as to resist the external force F1. At this time, the reaction force F2 is opposite to the external force F1 and has the same magnitude. That is, the external force F1 and the reaction force F2 are couples.

Consequently, a moment M of a couple resulting from the external force F1 and the reaction force F2 is generated with the lower base 56*b* at which the thickness t of the air intake apparatus main body 30 is minimized (tmin) as the rotation center O. Thus, as shown in FIG. 6, a force G based on the moment M of a couple is generated at a predetermined position of the air intake apparatus main body 30. When a distance from the rotation center O to the predetermined position is set to L, the force G acting on the predetermined position of the air intake apparatus main body 30 is G=M/L.

In this embodiment, as described above, the joining position P2 and the base 56*b* in the vicinity the joining position P2 are located further away from the flange 56*c* than the joining position P1 in the intake air flow direction. A force G1 acting on the joining position P1 is G1=M/L1 when a distance from the rotation center O (base 56*b*) to the joining position P1 is set to L1.

In an air intake apparatus 100*a* shown as a conventional example in FIG. 7, a case is assumed in which a joining position P2*a* is located at substantially the same position (on an A1 line) as a joining position P1 in an intake air flow direction. At this time, a distance L2*a* from a rotation center Oa to the joining position P1 is smaller than the shortest distance L1 in this embodiment. In the conventional example, a force G1*a* acting on the joining position P1 is G1*a*=M/L2*a*. The shortest distance L1 is larger than the distance L2*a*, and thus the force G1 becomes smaller than the force G1*a*. That is, the force G1 acting on the joining position P1 in this embodiment is smaller than the force G1*a* acting on the joining position P1 (force that causes the upper piece to separate from the middle piece) in the conventional example.

In this embodiment, as shown in FIG. 6, the A2 line that passes through the lower base 56*b* as the rotation center O and the joining position P1 intersects with the A1 line along which the joining surfaces 42*b* and 52*b* extend. Thus, the force G1 acting on the joining position P1 is decomposed into a force G2 acting in an A3 direction orthogonal to the joining surfaces 42*b* and 52*b* (force that causes the upper piece 40 to separate from the middle piece 50) and a force G3 acting in the A1 direction in which the joining surfaces 42*b* and 52*b* extend. Specifically, the force G2 that causes the upper piece 40 to separate from the middle piece 50 satisfies G2=G1 sin θ, and the force G3 acting in the A1 direction in which the joining surfaces 42*b* and 52*b* extend satisfies G3=G1 cos θ. Consequently, the force G2 that causes the upper piece 40 to separate from the middle piece 50 becomes even smaller than the force G1*a* (see FIG. 7) that causes the upper piece to separate from the middle piece in the conventional example. Specifically, the force G2 is further decreased such that G2/G1*a* satisfies G2/G1*a*=L1 cos θ/L1*a*.

Therefore, even when a force sufficient to separate the upper piece from the middle piece in the conventional example is applied to the air intake apparatus 100 in this embodiment, the force G2 that causes the upper piece 40 to separate the middle piece 50 becomes sufficiently small. Consequently, in the air intake apparatus 100 in this embodiment, separation of the joint between the upper piece 40 and the middle piece 50 due to separate of the upper piece 40 from the middle piece 50 is effectively significantly reduced or prevented. Therefore, interference of the upper piece 40 with the fuel supply component 110*b* disposed above the upper piece 40 is significantly reduced or prevented.

On the joining position P2 located in the vicinity of the base 56*b* (rotation center O), the force that causes the lower piece 60 to separate from the middle piece 50 hardly acts. Thus, separation of the lower piece 60 from the middle piece 50 is also effectively significantly reduced or prevented. Consequently, in the air intake apparatus 100 in which the middle piece 50, the lower piece 60, and the upper piece 40 are joined to each other, it is possible to make it difficult to cause breakage due to the separation when the external force F1 is applied to the air intake apparatus main body 30 from the opposite side to the engine 110.

Advantageous Effects of this Embodiment

According to this embodiment, the following advantageous effects are achieved.

According to this embodiment, as described above, the joining position P2 between the middle piece 50 and the lower piece 60 in the vicinity of the base 56*b* of the protrusion 56 of the middle piece 50 opposite to the intake port 110*c* is misaligned along the intake air flow direction with respect to the joining position P1 between the middle piece 50 and the upper piece 40 in the vicinity of the base 56*a* of the protrusion 56 of the middle piece 50. Accordingly, the joining position P2 in the vicinity of the base 56*b* serving as the rotation center O at which the moment of a couple is generated is misaligned along the intake air flow direction with respect to the joining position P1 such that as compared with the case in which the joining position P2 and the joining position P1 are located at the same position in the intake air flow direction, the joining position P1 can be moved away from the joining position P2 and the base 56*b*. Consequently, when the external force F1 is applied to the air intake apparatus main body 30 from the opposite side to the engine 110, the force G1 based on the moment M of a couple at the joining position P1 can be decreased, and thus the force G2 (G1) applied to the upper piece 40 in a direction away from the middle piece 50 can be decreased. Therefore, separation of the upper piece 40 from the middle piece 50 (separation of the joint between the upper piece 40 and the middle piece 50) can be significantly reduced or prevented, and thus when the external force F1 is applied to the air intake apparatus main body 30 from the opposite side to the engine 110, interference of the upper piece 40 with the fuel supply component 110*b* can be significantly reduced or prevented.

Furthermore, the joining position P2 between the middle piece 50 and the lower piece 60 is located in the vicinity of the base 56*b* of the protrusion 56 of the middle piece 50. Accordingly, the joining position P2 between the middle piece 50 and the lower piece 60 is located in the vicinity of the base 56*b* serving as the rotation center O of the moment of a couple, and thus when the external force F1 is applied to the air intake apparatus main body 30 from the opposite side to the engine 110, the force based on the moment M of a couple applied to the middle piece 50 and the lower piece 60 can be substantially zero or very small. Consequently, separation of the middle piece 50 from the lower piece 60 (separation of the joint between the middle piece 50 and the lower piece 60) can be reliably significantly reduced or prevented. Therefore, in the air intake apparatus 100 in which the middle piece 50, the lower piece 60, and the upper piece 40 are joined to each other, separation of the joint between the plurality of pieces that constitute the air intake apparatus main body 30 can be significantly reduced or prevented when the external force F1 is applied to the air intake apparatus main body 30 from the opposite side to the engine 110.

According to this embodiment, the joining position P2 in the vicinity of the base 56*b* of the protrusion 56 is located further away from the flange 56*c* than the joining position P1 in the intake air flow direction such that the joining position P2 can be provided in the inner portion of the air intake apparatus main body 30. Accordingly, as compared with the case in which the joining position P2 is located closer to the flange 56*c* than the joining position P1 (in an outer portion of the air intake apparatus main body 30), an unnecessary portion (waste portion) generated in at least one of the lower piece 60 and the middle piece 50 in order to locate the joining position P2 can be reduced. Consequently, the weight of the air intake apparatus 100 can be decreased.

According to this embodiment, the protrusion 56 extends obliquely downward toward the intake ports 110*c*. Furthermore, the joining position P2 is provided below the base 56*b* of the protrusion 56, and the joining position P1 is provided above the base 56*a* of the protrusion 56. In addition, the shortest distance L2 from the joining surface 56*e* of the flange 56*c* to the joining position P2 is larger than the shortest distance L1 from the joining surface 56*e* of the flange 56*c* to the joining position P1. Accordingly, the joining position P2 can be easily located further away from the flange 56*c* than the joining position P1.

According to this embodiment, in the vehicle mounted state, the air intake apparatus main body 30 is disposed in front of the engine 110. Furthermore, the upper piece 40 as well as the middle piece 50 that constitutes the resonance tubes 20 in the air intake passage I is disposed on the front end 30*a* side of the air intake apparatus main body 30. In addition, the joining position P2 is located further away from the engine 110 than the joining position P1. Accordingly, when the front of the vehicle 120 collides with an obstacle in the vehicle mounted state, and the external force F1 is applied to the air intake apparatus main body 30 such that the upper piece 40 is pushed from the front side (X1 direction) opposite to the engine 110 toward the engine 110 (rearward, X2 direction), separation of the upper piece 40 from the middle piece 50 can be significantly reduced or prevented.

According to this embodiment, the straight line A2α that connects the joining position P2 located in the vicinity of the rotation center O to the joining position P1 is inclined with respect to the direction in which the joining surface 42*b* (52*b*) at the joining position P1 extends (the direction in which the A1 line extends). Accordingly, when the external force F1 is applied to the air intake apparatus main body 30 from the opposite side to the engine 110, a portion of the force G1 based on the moment M of a couple at the joining position P1 can be released in a direction parallel to the joining surface 42*b* (52*b*). Consequently, the force G2 applied to the upper piece 40 in the direction away from the middle piece 50 can be further decreased, and thus separation of the upper piece 40 from the middle piece 50 can be further significantly reduced or prevented.

According to this embodiment, in the structure in which the joining position P1 is located in the vicinity of the fuel supply component 110*b*, the joining position P2 is misaligned along the intake air flow direction with respect to the joining position P1. Accordingly, separation of the upper piece 40 from the middle piece 50 can be significantly reduced or prevented, and thus when the external force F1 is applied to the air intake apparatus main body 30 from the opposite side to the engine 110, interference of the upper piece 40 with the fuel supply component 110*b* can be significantly reduced or prevented.

According to this embodiment, the lower piece 60, the middle piece 50, and the upper piece 40 are made of resins weldable to each other. Accordingly, in the air intake apparatus 100 in which the lower piece 60, the middle piece 50, and the upper piece 40 are welded to each other, it is possible to make it difficult to cause breakage due to the separation when the external force F1 is applied to the air intake apparatus main body 30 from the opposite side to the engine 110 and to realize weight reduction.

According to this embodiment, the lower piece 60 as well as the middle piece 50 defines the air intake passage I on the engine 110 side, and the upper piece 40 as well as the middle piece 50 defines the air intake passage I on the opposite side to the engine 110. Accordingly, the entire air intake passage I can be defined by the three pieces, and thus complicated manufacturing of each of the three pieces can be significantly reduced or prevented as compared with the case in which the entire air intake passage is defined by only one or two pieces.

MODIFIED EXAMPLES

The embodiment disclosed this time must be considered as illustrative in all points and not restrictive. The scope of the present invention is not shown by the above description of the embodiment but by the scope of claims for patent, and all modifications (modified examples) within the meaning and scope equivalent to the scope of claims for patent are further included.

For example, while the example in which the joining position P2 and the lower base 56*b* in the vicinity of the joining position P2 are located further away from the flange 56*c* than the joining position P1 in the air intake air flow direction has been shown in the aforementioned embodiment, the present invention is not restricted to this. In the present invention, like an air intake apparatus 200 according to a modified example of this embodiment in FIG. 8, a joining position P3 (an example of a first joining position) and a base 256*b* on the lower side of a protrusion 256 of a middle piece 250 (an example of an intermediate piece) in the vicinity of the joining position P3 may be located closer to a flange 56*c* than a joining position P1 in an intake air flow direction. Even in this case, the joining position P3 is misaligned along the intake air flow direction with respect to the joining position P1, and thus when an external force is applied to an air intake apparatus main body 230, a force based on a moment M of a couple at the joining position P1 can be decreased. Thus, a force applied to an upper piece 40 in a direction away from the middle piece 250 can be decreased. Consequently, separation of the upper piece 40 from the middle piece 250 (separation of a joint between the upper piece 40 and the middle piece 250) can be significantly reduced or prevented. In this case, it is possible to improve the mechanical strength around the joining position P3 between the middle piece 250 and a lower piece 260 (an example of a first piece) (a flange connected to a heavy throttle body, for example).

While the example in which the joining position P2 (first joining position) at which the middle piece 50 (intermediate piece) and the lower piece 60 (first piece) are joined to each other is located in the vicinity of the lower side of the base 56*b* on the lower side of the protrusion 56 has been shown in the aforementioned embodiment, the present invention is not restricted to this. In the present invention, the first joining position at which the intermediate piece and the first piece are joined to each other may be located at the position of the base on the lower side of the protrusion. Thus, the force based on the moment of a couple acting on the first joining position can be zero, and thus separation of the joint between the intermediate piece and the first piece can be reliably significantly reduced or prevented.

While the example in which the lower piece 60 (first piece), the middle piece 50 (intermediate piece), and the upper piece 40 (second piece) are made of resins weldable to each other has been shown in the aforementioned embodiment, the present invention is not restricted to this. In the present invention, the first piece, the intermediate piece, and the second piece may be made of materials other than the resins such as metal materials. In this case, in an air intake apparatus having the structure according to the present invention, separation of a fastening portion between an intermediate piece and a second piece fastened to each other by fastening members can be significantly reduced or prevented. Alternatively, any one or two of the first piece, the intermediate piece, and the second piece may be made of resins, and the remainder of the first piece, the intermediate piece, and the second piece may be made of a metal material.

While the example in which the resonance tubes 20 in the air intake passage I are spirally formed has been shown in the aforementioned embodiment, the present invention is not restricted to this. In the present invention, the shapes of the resonance tubes in the air intake passage are not limited to spiral shapes. For example, the resonance tubes in the air intake passage may be S-shaped.

In addition to the structure of the air intake apparatus 100 according to the aforementioned embodiment, a piece that defines an EGR passage and a piece that defines a blow-by gas passage may be attached to the air intake apparatus main body 30, for example. That is, the number of pieces constituting the air intake apparatus is not limited to three (the first piece, the second piece, and the intermediate piece), but may be four or more.

In addition to the structure of the air intake apparatus 100 according to the aforementioned embodiment, valves that can vary the lengths of the resonance tubes may be provided in the resonance tubes, for example, such that the air intake length in the air intake apparatus can be varied.

While the example in which the joining surface 42*b* of the upper piece 40 (second piece) and the joining surface 52*b* of the middle piece 50 (intermediate piece) extend along the A1 line that extends in the direction orthogonal to the intake air flow direction has been shown in the aforementioned embodiment, the present invention is not restricted to this. In the present invention, the joining surface of the second piece and the joining surface of the intermediate piece may extend along a straight line that extends in a direction that intersects not only with the intake air flow direction but also with the direction orthogonal to the intake air flow direction. The straight line described above preferably extends in a direction that intersects with the straight line (the A2 line in FIG. 6) that passes through the base and the second joining position.

While the example in which the upper piece 40 (second piece) is arranged at the position that overlaps with a portion of the fuel supply component 110*b* in the top view has been shown in the aforementioned embodiment, the present invention is not restricted to this. In the present invention, the second piece may be arranged in a position that does not overlap with the fuel supply component in the top view. Accordingly, when an external force is applied to the air intake apparatus main body from the opposite side to the internal combustion engine, interference of the second piece with the fuel supply component can be more effectively significantly reduced or prevented.

While the present invention is applied to the air intake apparatus 100 mounted on the in-line four-cylinder engine 110 has been shown in the aforementioned embodiment, the present invention is not restricted to this. That is, the air intake apparatus according to the present invention may be applied to a multi-cylinder engine other than an in-line four-cylinder engine, a V-type multi-cylinder engine, or the like. Alternatively, the present invention may be applied to an air intake apparatus of an internal combustion engine (engine) mounted in an equipment instrument other than an automobile, for example. The present invention may be applied to any of a gasoline engine, a diesel engine, a gas engine, etc. as the internal combustion engine.

DESCRIPTION OF REFERENCE NUMERALS

20: resonance tube
30, 230: air intake apparatus main body
40: upper piece (second piece)
50, 250: middle piece (intermediate piece)
56, 256: protrusion
56*a*: (upper) base
56*b*, 256*b*: (lower) base
56*c*: flange (intake port connection)
56*e*: joining surface (end face)
60, 260: lower piece (first piece)
100, 200: air intake apparatus
110: engine (internal combustion engine)
110*c*: intake port
I: air intake passage
P1: joining position (second joining position)
P2, P3: joining position (first joining position)

The invention claimed is:

1. An air intake apparatus comprising:

an intermediate piece including a protrusion that protrudes from an air intake apparatus main body toward an intake port of an internal combustion engine, and an intake port connection configured to connect to the intake port of the internal combustion engine;

a first piece joined to one side of the intermediate piece, the first piece as well as the intermediate piece defining an upstream side of an air intake passage; and a second piece joined to the other side of the intermediate piece, the second piece as well as the intermediate piece defining a downstream side of the air intake passage; wherein a first joining position between the intermediate piece and the first piece in a vicinity of a base of the protrusion of the intermediate piece opposite to the intake port is misaligned along an intake air flow direction with respect to a second joining position between the intermediate piece and the second piece in the vicinity of the base of the protrusion of the intermediate piece, and the first joining position is located further away from the intake port connection than the second joining position in the intake air flow direction.

2. The air intake apparatus according to claim 1, wherein the protrusion extends obliquely downward toward the intake port;

the first joining position is provided below the base of the protrusion;

the second joining position is provided above the base of the protrusion; and a shortest distance from an end face of the intake port connection to the first joining position is larger than a shortest distance from the end face of the intake port connection to the second joining position.

3. The air intake apparatus according to claim 1, wherein in a vehicle mounted state, the air intake apparatus main body is disposed in front of the internal combustion engine;

the second piece as well as the intermediate piece that constitutes a resonance tube in the air intake passage is disposed on a front end side of the air intake apparatus main body; and the first joining position is located further away from the internal combustion engine than the second joining position.

4. The air intake apparatus according to claim 1, wherein the first joining position and the second joining position are set in such a manner that a straight line that connects the first joining position to the second joining position is inclined with respect to a direction in which a joining surface at the second joining position extends.

5. The air intake apparatus according to claim 1, wherein in a vehicle mounted state, the second joining position is located in a vicinity of a fuel supply component.

6. The air intake apparatus according to claim 1, wherein the first piece, the intermediate piece, and the second piece are made of resins weldable to each other.

7. The air intake apparatus according to claim 1, wherein the first piece as well as the intermediate piece defines the air intake passage on a side of the internal combustion engine; and the second piece as well as the intermediate piece defines the air intake passage on an opposite side to the internal combustion engine.

* * * * *